United States Patent [19]

Howell et al.

[11] 4,236,437

[45] Dec. 2, 1980

[54] ORGAN BRASS PULSE KEYER

[75] Inventors: Stephen L. Howell; John W. Robinson, both of Jasper, Ind.; Donald Kube, San Jose, Calif.

[73] Assignee: Kimball International, Inc., Jasper, Ind.

[21] Appl. No.: 23,699

[22] Filed: Mar. 26, 1979

[51] Int. Cl.[3] ..... G10H 1/02

[52] U.S. Cl. ..... 84/1.26; 84/1.19; 84/DIG. 23

[58] Field of Search ..... 84/1.01, 1.19, 1.26, 84/1.13, DIG. 23

[56] References Cited

U.S. PATENT DOCUMENTS

| | | | |
|---|---|---|---|
| 3,637,915 | 1/1972 | Hirano | 84/DIG. 23 |
| 3,715,445 | 2/1973 | Kniepkamp | 84/1.26 |
| 3,746,775 | 7/1973 | Uchiyama | 84/1.26 |
| 4,070,943 | 1/1978 | Faulkner | 84/1.01 |
| 4,085,374 | 4/1978 | Nagahama | 84/DIG. 23 |
| 4,099,439 | 7/1978 | Luce | 84/1.19 |
| 4,141,270 | 2/1979 | Schrecongust | 84/1.19 |

*Primary Examiner*—J. V. Truhe

*Assistant Examiner*—Forester W. Isen

*Attorney, Agent, or Firm*—Albert L. Jeffers; John F. Hoffman

[57] ABSTRACT

A brass pulse keyer for electronic instruments such as electronic organs wherein the tone during attack is both amplitude modulated and pulse width modulated. The keyer is adapted for large scale integration and comprises a timing capacitor, an electronic switch connected between a source of charging potential and a capacitor and having a control terminal which is connected to the tone input, and a second electronic switch connected in series with the charge voltage, the first switch, and the capacitor and having a control terminal connected to receive the keying envelope. A comparator compares the potential on the capacitor with a reference potential and disables a gating circuit when a compare condition is reached such that the duty cycle may be controlled. As the keying envelope continues towards its maximum, the duty cycle decreases so that a more brilliant tone is achieved. This signal is connected to the input of an analog keyer, which is also controlled by the keying envelope such that amplitude modulation of the tone may also be achieved.

14 Claims, 4 Drawing Figures

ORGAN BRASS PULSE KEYER

BACKGROUND OF THE INVENTION

The present invention relates to a pulse generating circuit having simultaneous amplitude modulation and pulse width modulation, and in particular to such a circuit utilized as a brass keyer in electronic organs and the like.

As is well known, the tonal quality of a note produced by a musical instrument is dependent upon the harmonic content of the waveform of the note. In electronic organs, it is customary to generate square waves, which are then altered or filtered to produce waveforms having the desired harmonic content. The duty cycle of the square waves has a very pronounced effect on harmonic content, with pulse trains having a short duty cycle, i.e. a narrow pulse width, sounding more brilliant, and pulse trains having a longer duty cycle, i.e. a wider pulse width, sounding more mellow. An example of the former, is the sound produced by a trumpet, and an example of the latter is the sound produced by a saxophone.

A characteristic of the sound produced by brass instruments and some woodwind instruments is that during the attack portion of the tone, the amplitude increases and the tonal quality becomes more brilliant, i.e. the duty cycle decreases. This sound may be simulated in a electronic organ by causing the tone to gradually build in amplitude when the key is depressed with a gradual decrease in duty cycle. The duty cycle may either decrease simultaneously with the increase in amplitude, or lag the amplitude build up somewhat so as to simulate the effect which is produced when a mute is used with the trumpet or trombone. During decay, the pulse amplitude will decrease with the duty cycle becoming progressively longer. A small amount of white noise may be injected into the tone in order to simulate the breathy quality of brass tones.

Although the ability to simulate brass sounds is a desirable feature on electronic organs, the facts that a separate keyer is normally required for each note having brass voicing capability and the fact that a relatively large number of discreet components are necessary to produce the pulse width modulation necessary for brass voicing, have generally limited the capability for brass voicing to the more expensive organs. Furthermore, it is often difficult to adjust the various parameters of the brass keyers so as to properly balance the amplitude modulation and pulse width modulation so that separate keyers would often be required for the brass, trombone, saxophone, etc. voices.

SUMMARY OF THE INVENTION

The present invention overcomes the disadvantages of the prior art brass keyers by being particularly suited for LSI technology so that a number of keyers can be placed on a single chip. To insure uniformity, the control inputs for setting the various parameters, such as overall pulse width, pulse width modulation swing, amplitude modulation, and the like, could be common to all of the keyers. By allowing these parameters to be programmed by the setting of the organ tab switches, a single set of keyers could be utilized for a number of brass or brass-like sounds such as trumpet, trombone, clarinet and saxophone.

The brass keying system according to the present invention includes a gate having one input connected to the square wave tone source which is to be keyed and its other input connected to the output of a comparator. The comparator, in turn, has one of its inputs connected to a reference voltage and its other input connected to an external timing capacitor, which is charged each half cycle of the square wave tone signal and discharged on the alternate half waves. The degree to which the timing capacitor is charged is dependent on the conductivity level of an electronic switch, such as a field effect transistor, connected between the capacitor and a source of charge voltage. The control terminal for the electronic switch is connected to the keying envelope signal and causes the switch to become more conductive as the attack progresses.

When the comparator senses a compare condition, it disables the gate so as to block the square wave tone signal for the remainder of the full wave period. As the timing capacitor is charged to a greater degree as the attack portion of the envelope progresses, the comparator will flip earlier and earlier each cycle so that less and less of the square wave half cycle will be passed by the gate. This results in a pulse train having a progressively decreasing duty cycle until the keying envelope reaches a maximum.

This pulse train is fed to one input of an analog keyer having a control terminal also connected to the keying envelope input. The analog keyer keys the pulse width modulated pulse train with an amplitude which increases during the attack portion of the envelope, during which the pulse width is decreasing, and with a decreasing amplitude during the decay portion of the envelope, at which time the pulse width increases and returns to the initial pulse width produced at the beginning of the attack. A small amount of white noise is also added to the tone keyed by the analog keyer so as to simulate the breathy quality of brass tones.

The various parameters of the keying circuit may be easily controlled and programmed to produce a wide variety of effects. For example, the overall pulse width can be controlled by adjusting the reference potential for the comparator. The pulse width modulation, which is effected by the keying envelope, can be controlled by adjusting the conductivity of yet another electronic switch connected in parallel with the electronic switch which controls the rate at which the capacitor charges.

Specifically, the present invention is concerned with a circuit for producing a pulse train having a time varying duty cycle for use in an electronic organ brass keyer. The circuit comprises a source of keying potential having an envelope with predetermined attack and decay characteristics, a source of square wave tone signal, a timing circuit including a capacitor and having a time constant, an electronic switch for charging and discharging the capacitor on respective, alternate half cycles of the tone signal, wherein the switch includes variable impedance means having a control terminal connected to the source of keying potential for varying the time constant of the timing circuit in accordance with the keying potential, a comparator for comparing the voltage on the capacitor with a reference potential and producing a triggering signal whenever the voltage on the capacitor either exceeds or falls below the reference potential, and means for gating the tone signal with the triggering signal to produce an output pulse train having a time varying duty cycle.

An analog keyer connected to the source of keying potential and to the output pulse train comprises first and second field effect transistors connected in parallel with their respective sources connected at a first juncture and their respective drains connected at a second juncture, the gate of one of the first and second transistors being connected to the source of tone signal and the gate of the other transistor being connected to a source of white noise, a third field effect transistor connected in series between one of the first and second junctures and an output terminal and having its gate connected to the source of keying potential, the other of the junctures being connected to a source of bias voltage.

It is an object of the present invention to provide a brass pulse keyer for an electronic organ, or the like, which is suitable for large scale integration.

Another object of the present invention is to provide a brass pulse keyer for an electronic organ or the like wherein a single set of keyers can selectively simulate a variety of brass and woodwind instruments by appropriate programming of their control inputs.

DETAILED DESCRIPTION

Figure 1:
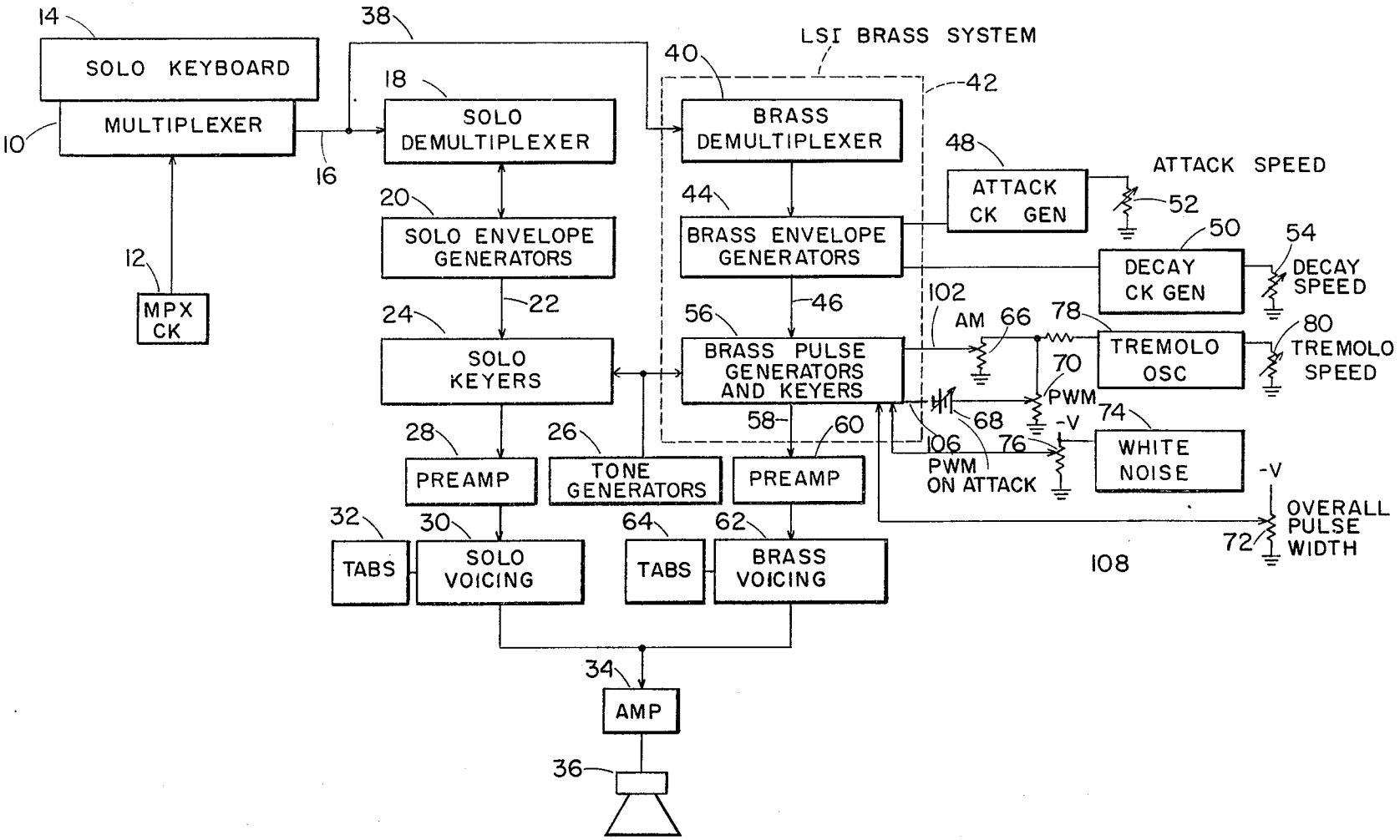
FIG. 1 is a block diagram of an electronic organ incorporating the brass keyer system according to the present invention.

Referring to FIG. 1, an electronic organ incorporating the brass pulse keying system of the present invention is shown. It comprises a multiplexer 10 driven by clock 12, and a solo keyboard 14, which is multiplexed by multiplexer 10 to produce a time division multiplexed serial data stream on line 16. This data stream is fed to solo demultiplexer 18, which activates selected solo envelope generators 20 to produce keying envelopes on lines 22. The envelopes, in turn, activate respective solo keyers 24 to key tone signals from tone generator 26 to preamp 28. The output of preamp 28 is fed to solo voicing circuits 30, which are controlled by tab switches 32, and from there to power amplifier 34 and speaker 36.

The solo data stream on line 16 is also fed over line 38 to the input of brass demultiplexer 40, which is contained within the LSI brass system 42. The output of demultiplexer 40 activates selected brass envelope generators 44 to produce keying envelopes on lines 46. Envelope generators 44 may either comprise conventional prior art envelope generators, or alternatively, digital control sustain-type envelope generators of the type disclosed in pending U.S. application Ser. No. 892,385, filed Mar. 31, 1978. In this type of envelope generator, rather than utilizing conventional resistor-capacitor circuits for timing, a capacitor connected to the juncture point of two series connected field effect transistors is charged through one of the transistors and discharged through the other transistors to a second capacitor connected to a point located serially between the second transistor and the envelope generator control terminal. The transistors are alternately and cyclically switched on and off so that the second transistor is incrementally charged during attack and incrementally discharged during decay. The attack timing is under the control of attack generator VCO 48, and the decay is under the control of decay clock generator VCO 50. By adjusting potentiometers 52 and 54, the speeds at which the two aforementioned field effect transistors are switched may be adjusted independently for the attack and decay portions of the envelope. The form of envelope generators 44 have no bearing on the present invention.

The outputs on lines 46 are fed to the inputs of brass pulse generators and keyers 56, which produce pulse trains on line 58 having amplitudes which progressively increase during the attack portion of the envelopes and progressively decrease during the decay portions thereof. The pulse trains are also pulse width modulated, with the pulse width decreasing during attack and increasing during decay. Brass pulse generators and keyers 56 are the subject of the present invention and will be described in greater detail hereinafter. The amplitude and pulse width modulated tones on line 58 are fed through preamp 60 to brass voicing circuits 62, which are under the control of tabs 64. From there they are amplified by power amplifier 34 and fed to speaker 36.

As will be described in greater detail below, the degree of amplitude modulation can be controlled by adjusting potentiometer 66, the degree of pulse width modulation by adjusting voltage source 68 and potentiometer 70, and the overall pulse width during the steady state portion of the keying envelope by adjusting potentiometer 72. White noise is fed into the keyers 56 by white noise generator 74 via potentiometer 76. Tremolo may be achieved by simultaneously driving the amplitude modulation and pulse width modulation portions of the pulse generators and keyers by a sine wave produced by oscillator 78. Potentiometer 80 adjusts the frequency of oscillator 78, which may be a voltage controlled oscillator. These controls may be permanently preset when the organ is manufactured, or preset and under the control of a number of tabs corresponding to various brass voices such as trumpet, trombone, clarinet and saxophone, or independently adjustable by the musician to provide analog control of the type found in synthesizers. This capability for programming is extremely important from the standpoint of low manufacturing costs because a single set of generators and keyers 56 can be utilized for a wide variety of brass and woodwind voices. Furthermore, the programming capability permits the same system to be utilized in simple, easy to play organs where the voices are preset, as well as in synthesizers where all of the controls are independently adjustable by the musician.

Figure 2:
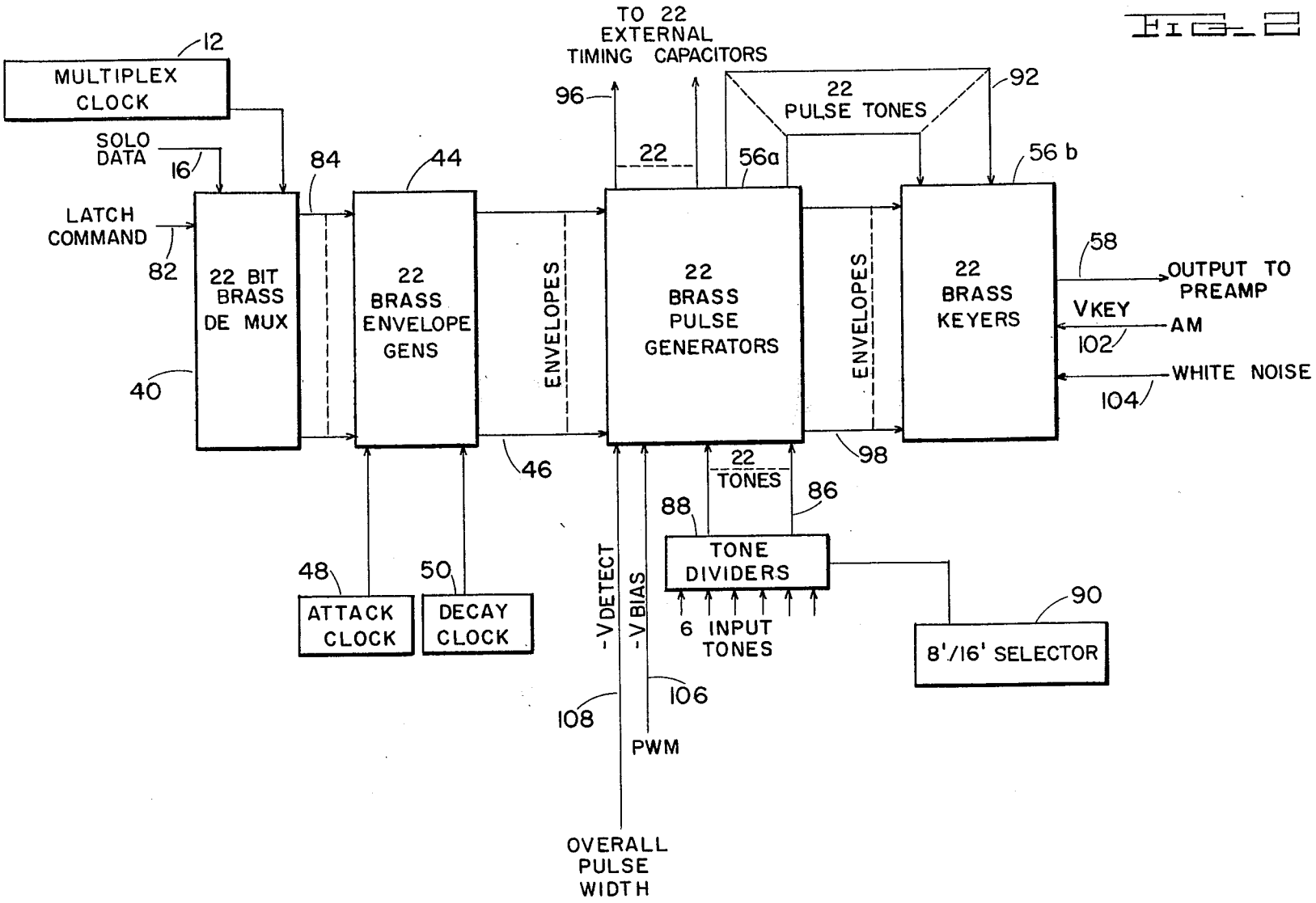
FIG. 2 is a block diagram of the brass keyer system.

Referring now to FIG. 2, the portion of FIG. 1 relating to the brass keying system is shown in greater detail. Demultiplexer 40, which receives the solo data stream on line 16 and the multiplex latch update command on line 82, provides outputs on selected ones of its output lines 84. The output lines 84 which are activated correspond to depressed keys of the keyboard 14, and activate corresponding brass envelope generators 44, which produce corresponding envelopes on lines 46. These envelopes have characteristic attack portions where the voltage changes exponentially from the zero voltage off level to the negative voltage steady state on level in an exponental fashion when the corresponding keys 14 are depressed. The steady state voltage remains as long as the key is depressed and then decays exponentially to the off level when the key is released. Such a keying voltage and the manner of producing it are well known in the art. It might be noted that the system shown in FIG. 2 corresponds to twenty-two brass keyers, although the present invention is not limited to the number of keyers, which may vary depending on the particular type of LSI technology and configuration which is utilized. By combining two such keyer systems, however, a standard forty-four note solo manual may be provided for.

Pulse generators 56*a* are fed by twenty-two tones over lines 86, which are produced in tone dividers 88 fed by six input tones. 8′/16′ selector 90, by bringing into operation a selectable divide-by-two divider, may shift the tones from 16′ to 8′ pitches. It should be noted that the present invention is not limited to the particular tone generating system shown, and any other tone generating system such as a top octave synthesizer, twelve separate oscillators for each of the top octave pitches, or any other suitable arrangement may be employed.

The outputs of pulse generators 56*a* on lines 92 comprise a plurality of pulse trains having time varying duty cycles so as to simulate the increase and decrease in brilliance of the tonal quality during attack and decay, respectively. The timing for the pulse width decrease and increase, which is generally exponential in nature, is provided by twenty-two external timing capacitors 94 (FIG. 3) connected to pulse generators 56*a* over lines 96. The keying envelopes on lines 46 are connected to output lines 98, which in turn are connected to the control terminals of analog keyers 56*b*. The envelopes on lines 98 cause keyers 56*b* to key the pulse width modulated pulse trains on lines 92 with the exponential attack and decay amplitude characteristics appropriate for brass tones. The outputs of keyers 56*b* are bussed together on line 58 for connection to preamp 60 (FIG. 1).

The $V_{key}$ voltage on line 102 potentiometer 66 controls the degree of amplitude modulation, and white noise is brought into keyer 56*b* over line 104. It should be noted that lines 102 and 104 are common to all of the keyers 56*b* so that uniform control is possible. The degree of pulse width modulation for pulse generators 56*a*, which is denoted as $-V_{bias}$, is brought in from potentiometer 70 and voltage source 68 over line 106 and is common to all of the pulse generators 56*a*. The $-V_{detect}$ voltage, which controls the overall pulse width, is brought into keyers 56*a* over line 108 from potentiometer 72, and is similarly common to each of the pulse generators 56*a*.

Figure 3:
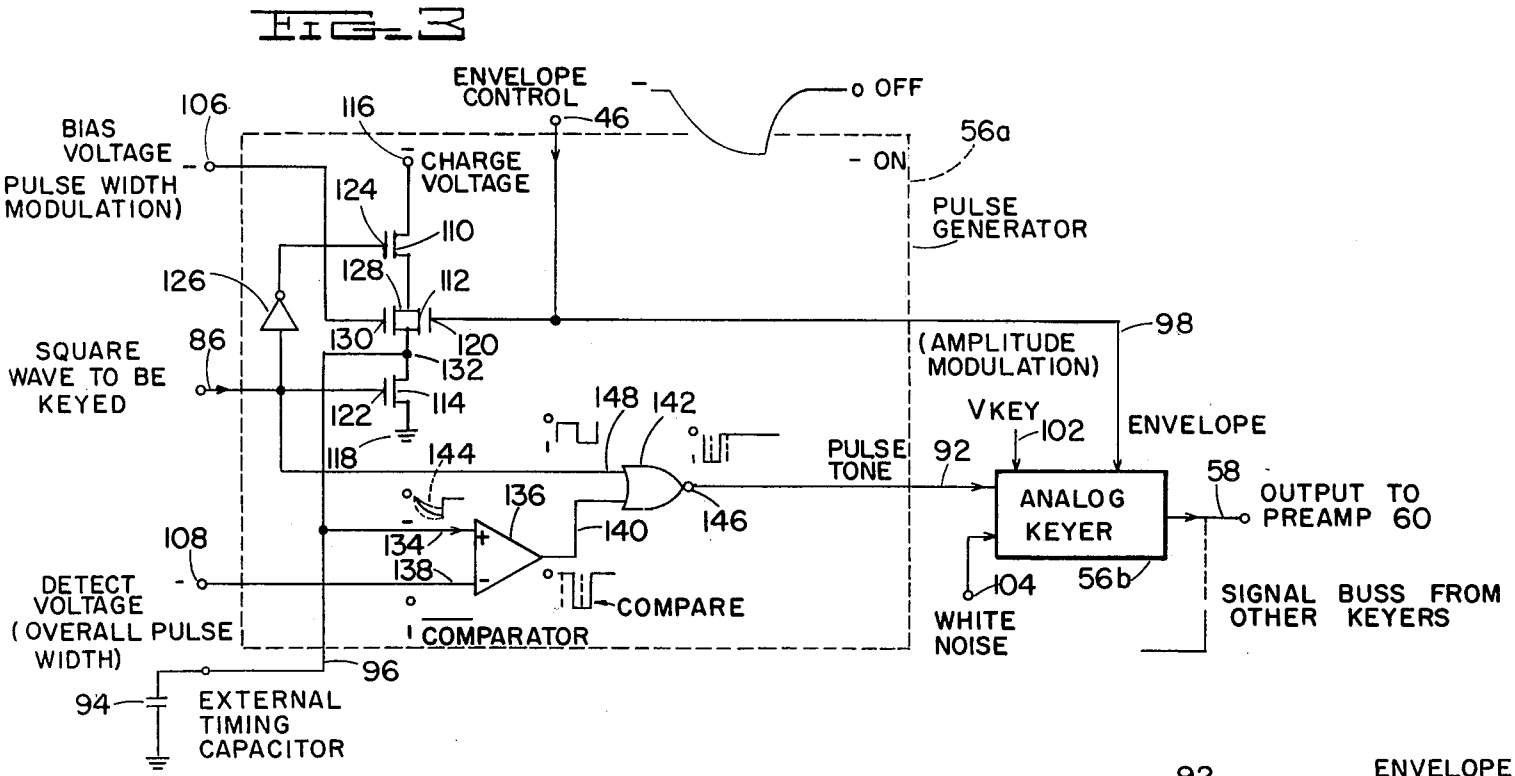
FIG. 3 is a detailed schematic of the brass pulse generators according to the present invention.

Referring now to FIG. 3, one of brass pulse generators 56*a* and its corresponding analog keyer 56*b* is shown in detail. In a preferred form of the invention, twenty-two generators 56*a* and twenty-two keyers 56*b* are contained on a single MOS integrated circuit chip. Brass pulse generator 56*a* comprises three field effect transistors 110, 112 and 114 serially connected between terminal 116, on which a negative DC charge voltage is present, and ground potential 118. The gate 120 for FET 112 is connected to terminal 46, which carries the keying envelope for one of the keys of keyboard 14. The gate terminal 122 for FEt 114 is connected to line 86, which carries a square wave tone from one of tone dividers 88. The gate terminal 124 for FET 110 is connected to line 86 through inverter 126. A further FET 128 is connected in parallel with FET 112 and has its gate terminal 130 connected to line 106, which carries an adjustable bias voltage to set the pulse width modulation. All of the FETs 110, 112, 114 and 130 become conductive with negative voltage.

The external timing capacitor 94 for the pulse generator is connected to the juncture 132 of FETs 114, 112 and 128 and to the non-inverting input 134 of MOS comparator 136. The inverting input 138 of comparator 136 is connected to line 108, which carries the detect voltage determinative of the overall pulse width of the pulse train on line 92 when steady state conditions have been reached. The voltage on line 108 is adjustable between zero volts, which corresponds to logic level 0, and the negative voltage corresponding to logic level 1. The output 140 of comparator 136 is connected to one of the inputs of NOR gate 142. The other input 148 of NOR gate 142 is connected to line 86 to receive the square wave tone from its corresponding divider chain 88. The compare condition for comparator 136, which occurs when the voltage on non-inverting input 134 exceeds (becomes more negative) than the voltage on terminal 138, output 140 goes to the logic 1 condition.

The output from NOR gate 142 is fed to one of the inputs of analog keyer 56*b* over line 92. Keyer 56*b* also receives an input over line 98 from the envelope control line 46, an input from the amplitude modulation control line 102, and an input from the white noise generator 74 over line 104. The output of analog keyer 56*b* is fed to preamp 60 over line 58 and is bussed together with signals from the other keyers 56*b* corresponding to the twenty-one other keys of keyboard 14.

In operation, FETs 110 and 114 are alternately and cyclically switched on and off, by virtue of inverter 126, under the control of the square wave tone signal on line 86. Assuming no envelope voltage on line 46, which is the condition when the corresponding key 14 is not depressed, FET 112 will be cut off so that FET 110 will have no effect. FET 114, however, will continue to be turned on each negative half cycle of the square wave tone on line 86 so as to keep capacitor 94 discharged to ground. This maintains the non-inverting terminal 134 of comparator 136 at logic level 0 (zero volts). Furthermore, logic level 0 on line 96 disables analog keyer 56*b* and no tone will be heard at the output of the organ.

When the key 14 corresponding to the individual pulse generator 56*a* and keyer 56*b* is depressed, a negative going voltage will appear on line 46. This voltage is normally very slow to increase, relative to the frequency of the square wave tone on line 86, and will cause FET 112 to slowly conduct more and more each positive half cycle of the square wave tone on line 86. As FET 112 begins to conduct, this allows a path for negative charge voltage from terminal 116 to flow through FETs 110 and 112 over line 96 into capacitor 94. During each positive half cycle, capacitor 94 will charge and then be rapidly discharged during the negative half cycle due to the increase in the conductivity of FET 114, which connects capacitor 94 to ground. During the early stages of attack, when the conductivity of FET 112 is relatively low, capacitor 94 will charge slowly so that the voltage 144 on non-inverting terminal 134 of comparator 136 will have a relatively low slope and will not reach the full negative charge voltage on terminal 116.

As the envelope control voltage on line 46 becomes more and more negative, FET 112 will become lower in resistance causing the negative voltage on capacitor 94 to eventually reach the minus detect voltage on the inverting terminal 136 of comparator 136. When this occurs, which will be relatively late in the positive half cycle of the pulse train 86 during the early stages of the attack portion of the control envelope on line 46, comparator 136 will flip to logic 1 and disable gate 142. Prior to that time, the two inputs of NOR gate 142 were at logic level 0 during the positive half cycle so that the full width of the half cycle pulse was passed to line 92. When comparator 136 flips, however, a logic 1 is presented to the input of gate 142 connected to line 140 and logic level 0 appears at its output 146. During the negative half cycle, the input 148 connected to line 86 will be at logic 1 and the gate 142 will remain disabled. At the beginning of the next positive half cycle of the pulse train on line 86, gate 142 will again see logic level 0 at each of its inputs, because comparator 136 has returned to its non-compare state with the discharging of capacitor 94. At this point, a logic level 1 will appear at the output 146 of gate 142.

As the envelope control voltage on line 46 becomes more and more negative during the later stages of attack, FET 112 will permit capacitor 94 to charge more rapidly so that the exponential voltage signal at the terminal 134 of comparator 136 will have a greater slope, and will therefore reach the detect voltage on line 108 at progressively earlier times. This will cause comparator 136 to trigger earlier so that the portion of the positive half wave tone signal passed by NOR gate 142 will become progressively less and less. This means that the pulse tone on line 92 will have a pulse width which becomes progressively narrower and the tone will sound more brilliant.

If the key is held down, the pulse width of the tone on line 92 will be determined by the detect voltage on line 108 and will remain the same until the key is released. During decay, which is characterized by a positive-going exponential voltage decay on line 46, the reverse process will occur, that is, the pulse train will have an increasing duty cycle because capacitor 94 will charge progressively more slowly. Obviously, a larger timing capacitor 94, a more negative detect voltage on line 108 or a less negative charge voltage on line 116 will cause a naturally wider output pulse. FET 128, which may be optionally installed, limits the amount of control the envelope voltage on line 46 has on the duty cycle modulation during attack and decay. By driving FET 128 with a sine wave, as from oscillator 78, the resistance path to charge capacitor 94 is modulated, and this can be used for the brass modulation half of brass tremolo. The amplitude modulation of the tremolo is obtained by driving a sine wave signal into the keying voltage input 102 of analog keyer **56*b*. This raises and lowers the current out of the keyer, which has the effect of raising and lowering the amplitude of the pulses. Another technique for obtaining brass tremolo would be to apply a sine wave superimposed on the envelope control voltage on line 46**.

Figure 4:
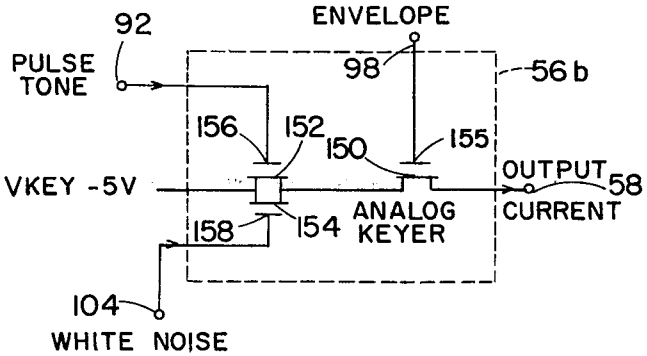
FIG. 4 is a detailed schematic of the analog keyer according to the present invention.

Referring now to FIG. 4, the analog keyer **56*b* is shown in detail. Keyer 56*b* comprises three field effect transistors 150, 152 and 154, with FETs 152 and 154 connected in parallel. The gate terminal 155 of FET 150 is connected to the brass envelope output 98 from the corresponding pulse generator 56*a*, and FET 150 is connected in series between the juncture of FETs 152 and 154 and output terminal 58. The gate terminal 156 for FET 152 is connected to the pulse tone output line 92 from pulse generator 56*a*. The gate terminal 158 for FET 154 is connected to the white noise input line 104 from white noise generator 74. Current will be supplied to the output 58 when either FET 152 or FET 154 is on, and the envelope FET 150 is at least partially on. Because of the increasing voltage on line 98, FET 150 will cause the amplitude of the output pulse train on line 58 to be low during the initial stages of attack and exponentially increase to its maximum when steady state conditions are reached or, alternatively, to the amplitude which is present on line 46 when the corresponding key is released. FET 150 also controls the amount of white noise injected into the signal on output 58. The output signal on line 58 is fed to preamp 60 and then to standard tab-controlled voicing circuits 62**.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed:

1. In an electronic organ, a circuit for producing a pulse train having a time varying duty cycle comprising:

a source of keyer potential having an envelope with predetermined attack and decay characteristics, a source of square wave tone signal, a timing circuit including a capacitor and having a time constant, electronic switch means connected to said timing circuit for charging and discharging said capacitor on respective alternate half cycles of said tone signal, said switch means including variable impedance means having a control terminal connected to said source of keying potential for varying the time constant of said timing circuit in accordance with said keying potential, comparator means including a first input connected to said capacitor, a second input connected to a reference potential, and an output, said comparator means comparing the voltage on said capacitor with said reference potential and producing a triggering signal on said output whenever the voltage on said capacitor one of exceeds or falls below said reference potential, and means connected to said comparator output and to said tone signal for gating said tone signal with said triggering signal to produce an output pulse train having a time varying duty cycle.

2. The organ of claim 1 wherein said variable impedance means comprises a field effect transistor connected between a charging potential and said capacitor.

3. The organ of claim 1 wherein said circuit for producing a pulse train is contained within an integrated circuit chip.

4. In an electronic organ including a playing key activated source of keying potential having predetermined attack and decay characteristics, a source of square wave tone signal, and output circuitry including acoustic transducer means, the improvement being an organ brass pulse keyer comprising:

a timing capacitor, electronic switch means connected to said capacitor for charging and discharging said capacitor on respective alternate half cycles of said tone signal, said switch means including variable impedance means having a control terminal connected to said source of keying potential for varying at least one of the charging or discharging time of said capacitor in accordance with said keying potential, comparator means including a first input connected to said capacitor, a second input connected to a reference potential, and an output, said comparator means comparing the voltage on said capacitor with said reference potential and producing a triggering signal on its said output whenever the voltage on said capacitor one of exceeds or falls below said reference voltage, and means connected to said comparator means output and said tone signal for gating said triggering signal with said tone signal and said source of keying potential to provide to said output circuitry a pulse train having an amplitude varying in accordance with said keying potential and a duty cycle varying in accordance with said triggering signal.

5. The organ of claim 4 wherein said means for gating comprises:

an electronic gate means having its inputs connected to receive said tone signal and said triggering signal for producing an output signal having constant amplitude and a duty cycle varying in accordance with said triggering signal, and keyer means having one input connected to receive said output signal and another input connected to said source of keying potential, said keyer means passing said output signal with an amplitude varying in accordance with said keying potential.

6. The organ of claim 4 including player programmable means for adjusting the amplitude and duty cycle of said pulse train to simulate a selected one of a plurality of brass instruments.

7. The organ of claim 4 including means for cyclically modulating the amplitude and duty cycle of said pulse train.

8. The organ of claim 7 wherein said means for cyclically modulating simultaneously modulates the amplitude and duty cycle of said pulse train to produce a tremolo effect.

9. An organ brass pulse keyer comprising:

a source of non-cyclically varying keying potential, a source of square wave tone signal, a source of charging potential, a timing capacitor, first electronic switch means having a control terminal and being connected in series between said source of charging potential and said capacitor, said control terminal being connected to said tone signal source, second electronic switch means having a control terminal and being connected in series with said first switch means and in series between said source of charge voltage and said capacitor, said control terminal of said second switch means being connected to said keying potential, means for comparing the potential on said capacitor with a reference potential and providing a triggering signal whenever the voltage on said capacitor one of exceeds or falls below the reference potential, means for gating the triggering signal with the square wave tone signal to produce a first pulse train having a time varying duty cycle, and analog keyer means for keying said first pulse train with said keying potential to produce a second pulse train having an amplitude varying in accordance with said keying potential and a duty cycle varying in accordance with said first pulse train.

10. In an electronic musical instrument having a source of tone signal, a source of keying potential, a source of white noise and a source of bias voltage, the improvement being a keyer comprising:

first and second field effect transistors connected in parallel with their respective sources connected at a first juncture and their respective drains connected at a second juncture, the gate of one of said first and second transistors being connected to said source of tone signal and the gate of the other of said first and second transistors being connected to said source of white noise, a third effect transistor connected in series between one of said first and second junctures and an output terminal and having its gate connected to said source of keying potential.

the other of said first and second junctures being connected to said source of bias voltage.

11. The keyer of claim 10 wherein said keyer is contained within a single integrated circuit chip.

12. In an electronic organ, a circuit for producing a pulse train having a time varying duty cycle comprising:

a source of keying potential having an envelope with predetermined attack and decay characteristics, a source of square wave tone signal, a timing circuit including a capacitor and having a time constant, electronic switch means for charging and discharging said capacitor on respective alternate half cycles of said tone signal, said switch means including variable impedance means having a control terminal connected to said source of keying potential for varying the time constant of said timing circuit in accordance with said keying potential, said switch means comprising three field effect transistors connected in series wherein two of said field effect transistors are connected in series between said charging potential and said capacitor, one of said field effect transistors being said variable impedance means and having its control terminal connected to said source of keying potential, another of said field effect transistors having its control terminal connected to said source of tone signal, and inverting means operatively connected between said source of tone signal and the control terminal of the remaining said field effect transistor, comparator means for comparing the voltage on said capacitor with a reference potential and producing a triggering signal whenever the voltage on said capacitor one of exceeds or falls below said reference potential, and means for gating said tone signal with said triggering signal to produce an output pulse train having a time varying duty cycle.

13. The organ of claim 12 including a fourth field effect transistor connected in parallel with said one field effect transistor and having its control terminal connected to a source of biasing potential.

14. In an electronic organ including a playing key activated source of keying potential having predetermined attack and decay characteristics, a source of square wave tone signal, and output circuitry including acoustic transducer means, the improvement being an organ brass pulse keyer comprising:

a timing capacitor, electronic switch means for charging and discharging said capacitor on respective alternate half cycles of said tone signal, said switch means including variable impedance means having a control terminal connected to said source of keying potential for varying at least one of the charging or discharging time of said capacitor in accordance with said keying potential, said switch means further comprising three field effect transistors connected in series wherein two of said field effect transistors are connected in series between said charging potential and said capacitor, one of said field effect transistors being said variable impedance means and having its control terminal connected to said source of keying potential, another of said field effect transistors having its control terminal connected to said source of tone signal, and inverting means operatively connected between said source of tone signal and the control terminal of the remaining said field effect transistor, comparator means for comparing the voltage on said capacitor with a reference potential and producing a triggering signal whenever the voltage on said capacitor one of exceeds or falls below said reference potential, and means for gating said triggering signal with said tone signal and said source of keying potential to provide to said output circuitry a pulse train having an amplitude varying in accordance with said keying potential and a duty cycle varying in accordance with said triggering signal.

* * * * *

UNITED STATES PATENT AND TRADEMARK OFFICE

CERTIFICATE OF CORRECTION

PATENT NO. : 4,236,437

DATED : December 2, 1980

INVENTOR(S) : Stephen L. Howell; John W. Robinson and Donald Kube

It is certified that error appears in the above–identified patent and that said Letters Patent are hereby corrected as shown below:

Column 5, line 58, change "FEt" to --FET--.

Claim 10, column 10, line 11, after "third" insert --field--.

Signed and Sealed this

*Tenth* Day of *March 1981*

[SEAL]

*Attest:*

RENE D. TEGTMEYER

*Attesting Officer* *Acting Commissioner of Patents and Trademarks*